United States Patent [19]

Westlund

[11] 4,209,712

[45] Jun. 24, 1980

[54] ARRANGEMENT FOR INSTALLING ELECTRIC OR ELECTRONIC EQUIPMENT IN APPARATUSES FOR DISPENSING FUEL

[75] Inventor: Jan Westlund, Åkersberga, Sweden

[73] Assignee: Auto Tank AB, Bromma, Sweden

[21] Appl. No.: 916,008

[22] Filed: Jun. 16, 1978

[30] Foreign Application Priority Data

Jun. 16, 1977 [SE] Sweden ..... 7707017

[51] Int. Cl.[2] ..... H01H 35/24

[52] U.S. Cl. ..... 307/118; 307/149; 340/626; 222/23

[58] Field of Search ..... 222/23, 25, 26, 27, 222/28, 35, 36, 37; 340/626; 235/144 D; 307/118, 149–157; 73/49.2, 49.3; 200/81 R, 83 A

[56] References Cited

U.S. PATENT DOCUMENTS

| | | | |
|---|---|---|---|
| 3,216,659 | 11/1965 | Ambler et al. | 235/144 D |
| 3,688,291 | 8/1972 | Bateman et al. | 222/26 X |
| 3,894,658 | 7/1975 | Buell | 222/28 X |
| 4,049,935 | 9/1977 | Gruber | 200/83 A X |

*Primary Examiner*—L. T. Hix
*Assistant Examiner*—James L. Dwyer
*Attorney, Agent, or Firm*—Burns, Doane, Swecker & Mathis

[57] ABSTRACT

An arrangement for installing electronic counters in a petrol pump comprising a pressure-tight casing for accommodating the counters, means for providing an excess air pressure in the interior of the casing and a pressure-controlled switch inside the casing for interrupting the current supply to the counters when the pressure falls below a specific level.

6 Claims, 4 Drawing Figures

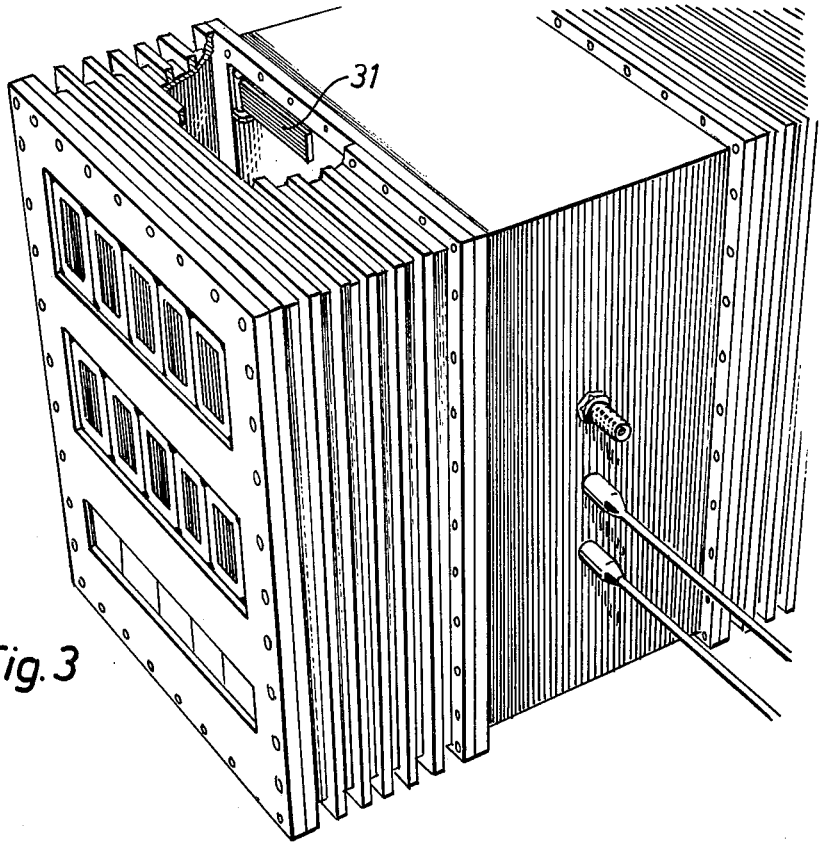
Fig. 3
Fig. 4
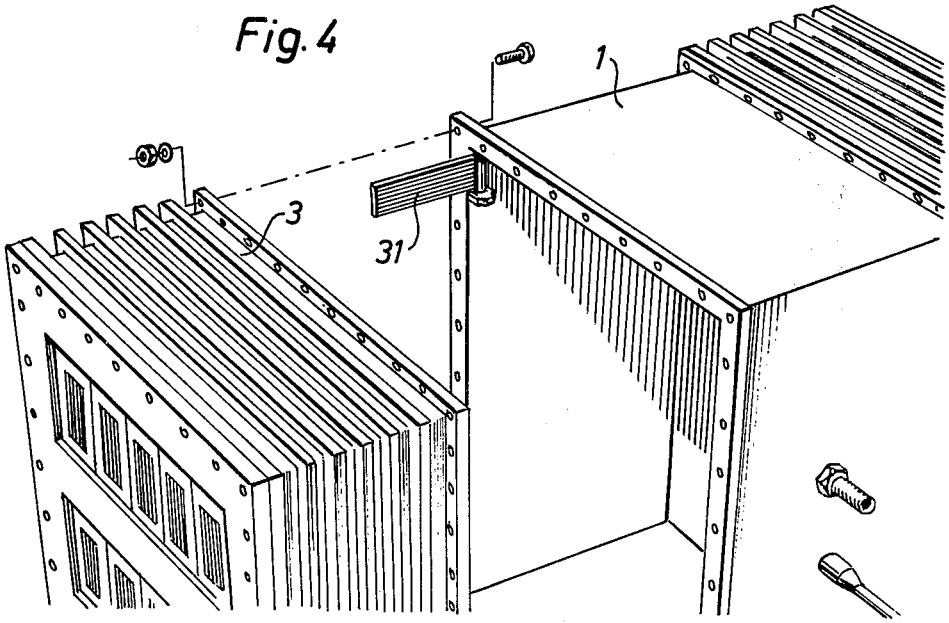

ARRANGEMENT FOR INSTALLING ELECTRIC OR ELECTRONIC EQUIPMENT IN APPARATUSES FOR DISPENSING FUEL

The present invention relates to the installation of electric or electronic equipment, particularly electronic computarized counters in apparatuses for dispensing fuel, herein after referred to as fuel pumps in the following specification.

Older types of fuel pumps are generally equipped with mechanical counting devices. These mechanical counters have a number of drawbacks in comparison with modern electronic computerized counters, and for this reason the latter have been more and more frequently utilized in connection with fuel pumps in recent years. Because electrical and electronic equipment in combination with fuel fumes, particularly petrol fumes, involves great risk of explosion, the use of electronic counter equipment in this connection is associated with severe restrictions bearing on its installation in connection with petrol pumps. The electronic counters as well as peripheral equipment must thus be either of intrinsically safe construction, which is expensive, or arranged as a separate unit from the pump itself, as a ruel on top of it.

The above situation means that the design situation is extremely restricted in the manufacture of fuel pumps, and also that modernization of older pumps by exchanging mechanical counters for electronic ones is hardly possible at acceptable costs.

The object of the present invention is to provide an arrangement for installing electric or electronic equipment in fuel pumps, whereby the above-mentioned drawbacks and difficulties are overcome.

This object has been achieved by the arrangement including a pressure-proof casing or housing arranged to accomodate said equipment, means for pressurization of the housing interior with the aid of a gas, preferably air, and a pressure-sensitive switch arranged inside the housing, circuited to break the power supply to said equipment when the pressure inside the casing falls below a specific level. Preferably, the arrangement also includes pressure-proof through passages for power supply and other cables to said equipment.

An arrangement made in this way, the casing of which can be provided with windows behind which are visible the electronic counter digits, as well as other information, can be placed anywhere in a fuel pump, and thus simply replace mechanical counters in an older type of pump. The excess pressure provided and maintained inside the casing prevents infiltration of for instance petrol fumes, whereby the risk of explosion is excluded. If a leak in the casing does occur, the pressure-sensitive switch will interrupt current supply to the equipment inside the casing before the pressure therein has fallen to a level such that petrol fumes can infiltrate through such a leakage site.

Means for putting the interior of the casing under excess pressure suitably include connection means for a source of pressurized gas, said connection means being arranged in the very casing. The connection means can consist of a conventional filling/ventilating valve or nipple of the type used in connection with automobile tires. The compressed air equipment to be found at every service station can hereby be utilized for checking and adjusting the excess pressure in the casing, suitably as a routine measure.

The casing is suitably partable or openable to enable access to the encapsulated equipment, e.g. for testing or service. To enable normal current supply on such occasions (which naturally does not take place where petrol fumes may be present), a special switch can be arranged for bypassing the pressure-sensitive switch. The former is preferably arranged so that it is automatically open when the casing is opened or parted. Said switch can be spring-loaded to go from open to closed when a part or cover of the casing is removed, and so that the casing cannot be reclosed without the switch returning to the open position.

The invention will now be described in more detail while referring to the four figures on the accompanying drawing.

FIG. 3 is a schematic partial perspective view of the apparatus in FIG. 1, the casing being partially cut away to illustrate the arrangement of a switch for bypassing the pressure switch when the casing is opened.

FIG. 4 is a schematic partial perspective view of the apparatus in FIG. 3 with the casing opened to illustrate the operation of the bypass switch.

Figure 1:
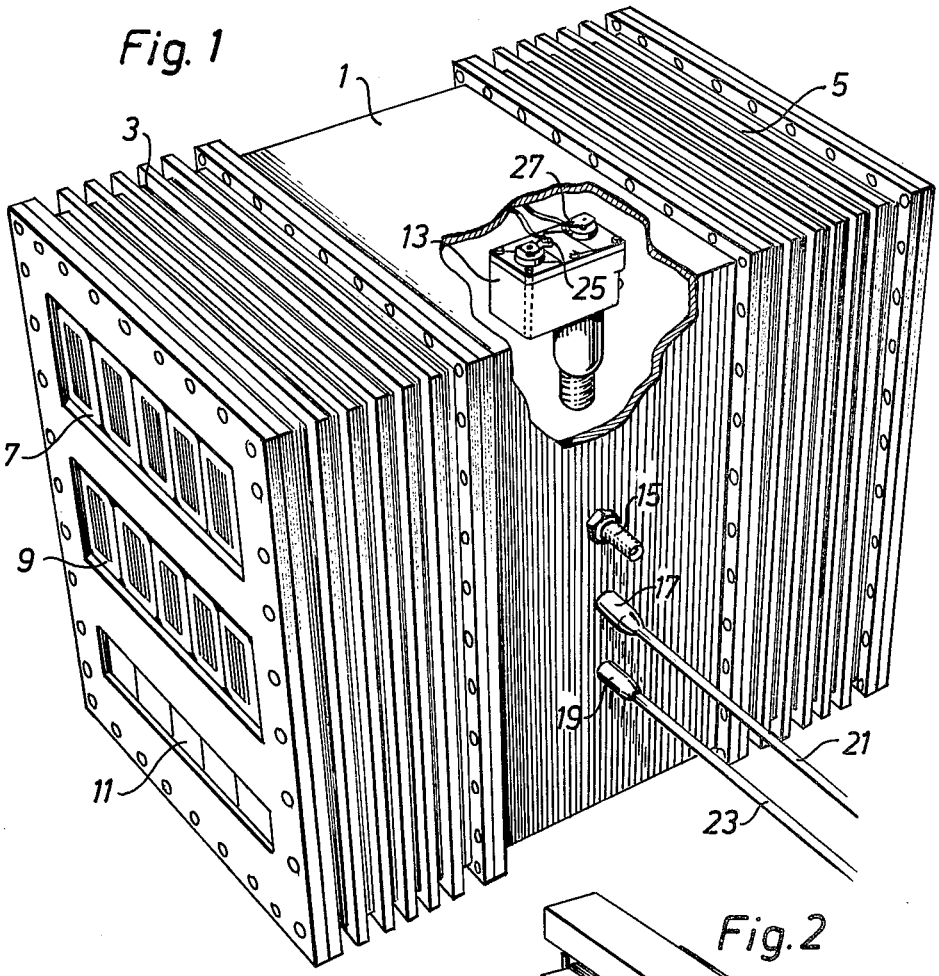
FIG. 1 is a schematic perspective view of an apparatus according to the present invention, the casing included in the apparatus being partially cut away to show schematically the arrangement of a pressure switch.

The apparatus according to the invention, shown on the drawing, comprises a parallelepipedic box casing, consisting of a centrally situated quadratic box frame 1, open at both sides, casing or cover parts 3, 5 being screwed pressure-tight to the sides of said frame. Parts 3, 5 are made alike, and on their opposing end walls they are provided with windows 7, 9 and 11 for showing digits on electronic price and volume counters fitted (in a way not more closely shown) into the casing as well as other information such as grade selection, for instance.

In FIG. 1, a pressure-sensitive switch or pressure monitor 13 is shown only schematically inside the box frame 1. In a side wall of the box frame there are a conventional filling/ventilating valve or nipple 15, fitted pressure-tight, and two lead-throughs or bushings 17, 19 for pressure-tight through passage of a current supply cable 21 and a signal cable 23, respectively. The current conductor of the cable 21 is applied to one terminal 25 on the switch 13, and continues from its other terminal 27 to the electronic equipment.

The contacts of switch 13 are closed as long as the pressure inside the casing sensed by the switch exceeds a specific value.

An example of a suitable pressure switch is the ASCO Tripoint series SB with transducer TE 10 A 11 for static pressure. The contacts of this switch are closed if the pressure it senses exceeds ca 1.5 bar.

In FIGS. 3 and 4 there is schematically shown a possible arrangement and function of an operating mechanism 31 for a pressure switch bypassing switch (not more closely shown). The operating mechanism 31 is arranged at the flange for screwing the casing part 3 onto the frame 1. The mechanism includes a spring-loaded hinged rod, biased so that on release it swings out from a position substantially parallel to said flange to a position substantially perpendicular thereto. In its retracted position the rod acts on the bypass switch (not more closely shown) so that the switch is open. When the rod is swung out completely, the switch is actuated to close its contacts for bypassing the pressure switch. The rod is arranged for coaction with an abutment (not shown) on the casing part 3 facing towards frame 1. It will be observed that the part 3 cannot be screwed onto the frame 1 before the rod 31 has been completely retracted, thereby ensuring the function of the pressure switch.

A corresponding operating mechanism with associated switch is also suitably arranged in conjunction with the attachment of the other casing part 5 to the frame 1.

Figure 2:
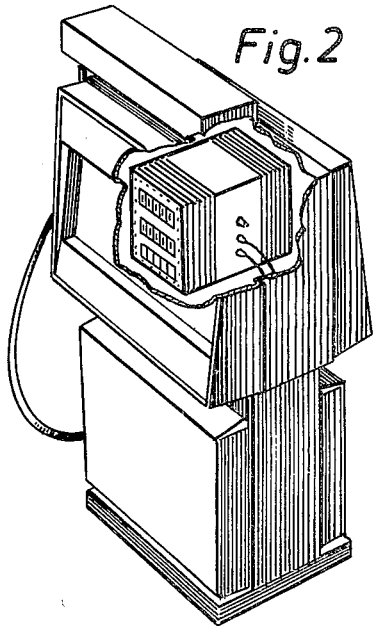
FIG. 2 is a partially cut-away schematic perspective view of a petrol pump provided with an apparatus according to FIG. 1.

In FIG. 2 there is schematically shown an example of how an apparatus according to FIG. 1 can be built into a conventional petrol pump. It will be appreciated that the apparatus according to the invention enables modernization of old types of pump, simply by lifting out the old mechanical counters and by placing an apparatus according to the invention in the free space thereby obtained, with the window sides of the casing facing towards the respective front and rear sides of the pump. The pump must of course be supplemented by suitable transducers for feeding the necessary signals via the cable 23 to the electronic equipment inside the casing protected by excess pressure.

What is claimed is:

1. Apparatus for improving the safety of the installation of electrical and electronic equipment in a device for dispensing fuel, comprising:

a pressure tight casing for housing electrical and electronic equipment;

means for establishing a gas pressure in the interior of said casing; and pressure sensitive switch means located within the interior of said casing and operative to interrupt a supply of electrical power to electrical and electronic equipment located within said casing when the pressure in the interior of the casing falls below a predetermined value.

2. An arrangement as claimed in claim 1, characterized in that said means for establishing a gas pressure include connecting means arranged in the casing for connecting the casing to a pressurized gas source.

3. An arrangement as claimed in claim 2, characterized in that said connecting means is adapted to be connected to compressed air equipment used in petrol stations.

4. An arrangement as claimed in claim 2 or 3, characterized in that said connecting means comprises a conventional filling/ventilating valve.

5. An arrangement as claimed in claim 1, characterized in that the casing is openable and further including a switch arranged for bypassing the pressure sensitive switch means when the casing is opened, so that equipment normally supplied with current via the pressure sensitive switch means is still supplied with current, for testing, service or the like.

6. An arrangement as claimed in claim 1, further including pressure-tight lead-through means in the casing for connecting at least a power supply cable to equipment located in said casing.

* * * * *